US010815029B2

(12) United States Patent
Rigas

(10) Patent No.: US 10,815,029 B2
(45) Date of Patent: Oct. 27, 2020

(54) PALLET BOX

(71) Applicant: George Rigas, Boston, MA (US)

(72) Inventor: George Rigas, Boston, MA (US)

( * ) Notice: Subject to any disclaimer, the term of this patent is extended or adjusted under 35 U.S.C. 154(b) by 0 days.

(21) Appl. No.: 15/891,337

(22) Filed: Feb. 7, 2018

(65) Prior Publication Data

US 2019/0241310 A1 Aug. 8, 2019

(51) Int. Cl.
*B65D 19/20* (2006.01)

(52) U.S. Cl.
CPC .... *B65D 19/20* (2013.01); *B65D 2519/00019* (2013.01); *B65D 2519/00034* (2013.01); *B65D 2519/00054* (2013.01); *B65D 2519/00069* (2013.01); *B65D 2519/00124* (2013.01); *B65D 2519/00159* (2013.01); *B65D 2519/00174* (2013.01); *B65D 2519/00194* (2013.01); *B65D 2519/00208* (2013.01); *B65D 2519/00273* (2013.01); *B65D 2519/00288* (2013.01); *B65D 2519/00323* (2013.01); *B65D 2519/00338* (2013.01); *B65D 2519/00497* (2013.01); *B65D 2519/00562* (2013.01); *B65D 2519/00621* (2013.01); *B65D 2519/00666* (2013.01); *B65D 2519/00726* (2013.01)

(58) Field of Classification Search
CPC ..... B65D 5/00; B65D 13/00; B65D 13/04; B65D 19/00; B65D 19/02; B65D 19/20; B65D 19/38; B65D 85/64; B65D 2519/00019; B65D 2519/00124
USPC ..... 206/386, 460, 595–600, 813; 229/126–160.2
See application file for complete search history.

(56) References Cited

U.S. PATENT DOCUMENTS

| | | | | |
|---|---|---|---|---|
| 2,048,895 A * | 7/1936 | Rosen | B65D 65/22 229/198.2 |
| 2,998,180 A * | 8/1961 | Dehoney, Jr. | B65D 5/0227 229/136 |
| 3,695,506 A * | 10/1972 | Cook | B65D 19/20 206/599 |
| 3,743,166 A | 7/1973 | Heavner | |
| 3,940,101 A * | 2/1976 | Heidelbach | B65D 19/20 206/386 |
| 2004/0025756 A1 | 2/2004 | Baker et al. | |

FOREIGN PATENT DOCUMENTS

| | | | |
|---|---|---|---|
| GB | 2135972 A * | 9/1984 | B65D 19/20 |
| GB | 2148255 A * | 5/1985 | B65D 19/20 |

* cited by examiner

*Primary Examiner* — Bryon P Gehman

(57) ABSTRACT

A system is provided comprising a box with four bottom flaps, at least four durable pegs projecting from exterior surfaces of two opposing bottom flaps, the pegs positioned to function as a built-in pallet structure for the box, adhesive strips on interior surfaces of the two opposing bottom flaps to promote closure of the bottom flaps, four top flaps, interior surfaces of two opposing top flaps containing protected adhesive strips to promote closure of the top flaps, and wax paper covering the adhesive strips prior to use of the strips. The pegs are constructed from the same material as the box. Material comprising the pegs is denser than material comprising the box. The denser concentration of the peg material enables the pegs to sustain weight of the box and contained items. The pegs are positioned on the opposing bottom flaps.

18 Claims, 7 Drawing Sheets

PALLET BOX

CROSS-REFERENCE TO RELATED APPLICATIONS

Not applicable.

RELATED CO-PENDING U.S. PATENT APPLICATIONS

Not applicable.

INCORPORATION BY REFERENCE OF SEQUENCE LISTING PROVIDED AS ATEXT FILE

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention generally relate to an apparatus comprising a completely enclosing pallet box container intended for the safe and secure collection and storage of material, such as mail parcels and other items, as well as the safe and secure enclosure and movement of the pallet box and its contents. The bottom plane of the pallet box includes supporting pegs, forming an attached pallet board on which the structure and its contents may rest when constructed and in use. These supporting pegs are of size and dimensions that allow the pallet box and its contents to be safely moved by forklift or pallet jack.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Package and mail handlers at postal services and other large shipping organizations may create box/pallet combinations to sort items. They may then use forklifts or hand-jacks to move such box/pallet combinations once full of shipped items. To create this box/pallet combination a worker may fold a modified paperboard box from its closed and flat position into the shape of a box. However, this modified box does not feature top closing flaps, and the bottom closing flaps are only half the width of a regular box.

The user in previous implementations may fold the bottom flaps of the modified box in a manner to hold the box in the open position. It takes a significant amount of time to open the box and then fold the bottom flaps in a way that holds the box open. And even when the worker does appropriately fold the flaps, there still may be an opening in the center bottom of the box due to the size of the flaps.

Once the box of previous implementations is folded it must be set upon a plastic pallet. It takes time and ability to fold the flap in a manner to hold open the box. The box also has a hole in the bottom. Since the box only sits on a pallet, if the box slides in any direction, mail or other items can fall out of the hole. Further, such boxes do not have top flaps so items may fall out. As they do not have completely closed tops and bottom, items are at risk of being lost. Users may also need to use tape or other materials to close such boxes.

In previous implementations, pallets are needed nearby, but they take up space in a storage area. That occupied space limits the area for product storage, which can be very limiting, especially to stores, mail centers and other places with frequent traffic and high product turnover. The workers are limited, too, in the space in which they move about in such environments. Then there is the cost of pallets. Pallets aren't cheap. They also need frequent replacement. Add in the cost of labor for the time it takes to get the pallet, load it, then move it back to a storage area after its emptied, and it can add up to almost a week's worth of labor cost every year.

When lifting a pallet with a forklift and moving it to a new location those small, loose contents may move inside the container. This motion can make the box move, and even slide upon the pallet, making its placement off-center and imbalanced. This leaves the box at risk of falling off the pallet. Many boxes commonly used in the storage and transport of small items have no lids so any movement inside the container creates a spill risk. Some even have bottom planes that don't close in full, leaving items at risk of falling out from both ends. Just like items can fall out of those boxes, things can fall in through their open, lid-less tops, too, which means those contents are at twice the risk.

A basic pallet can certainly get lots of use but it doesn't exactly get completely used, however. There's a common overlap of a pallet's surface area left from the boxes stored on top. Sprained ankles, broken toes, and other injuries from trips and falls all caused by accidental contact with the extending portion of a pallet. When the eyes see boxes and items that rest on top, the mind commonly associates their sidewalls to be the edge of the hosting pallet. Safety risks increase when pallets are in use. Not just the splinters and other hand and foot injuries that occur when lugging those wooden pallets around, but major injuries, caused when they fall from a stand-up storage position and strike nearby workers.

Previous implementations also involve storage-box portions that are not flush with pallet base, so there is a continuing risk of accidental foot contact caused by underestimating how far the pallet extends beyond the container it hosts. A wooden, metal, or industrial plastic pallet is heavy and firm, and can cause serious injury should it fall. It can also damage other objects in the vicinity.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
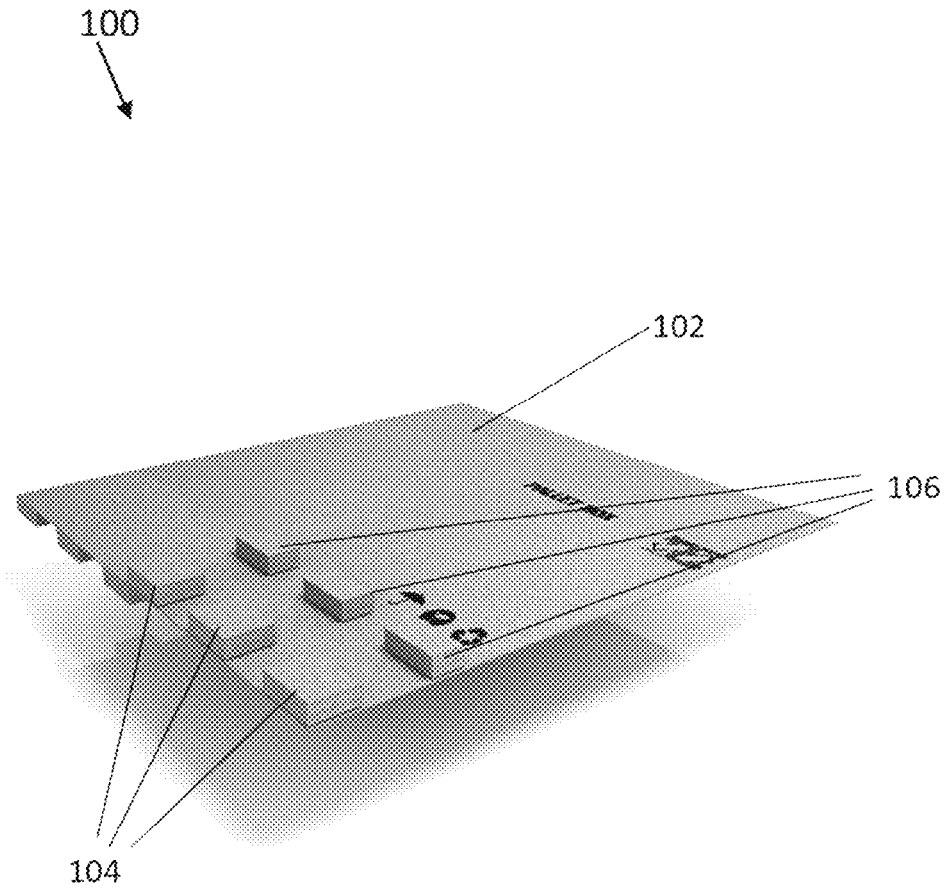
FIG. 1 is a diagram of the pallet box in accordance with an embodiment of the present disclosure, the pallet box depicted in a flattened state with a row of full-sized pegs and a row of half-sized pegs shown wherein a second row each of full-sized pegs and half-sized pegs is also present but not visible as the second row is affixed on underside portions of the pallet and are hence not visible.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settle law, as early as 1939, that words of approximation are not indefinite in the claims even when such limits are not defined or specified in the specification.

For example, see *Ex parte Mallory,* 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See *Energy Absorption Sys., Inc.* v. *Roadway Safety Servs., Inc.*, Civ. App. 96-1264, slip op. at 10 (Fed. Cir. Jul. 3, 1997) (unpublished) *Hybridtech* v. *Monoclonal Antibodies, Inc.,* 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See *Seattle Box Co.* v. *Industrial Crating & Packing, Inc.,* 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, *L.L.C.* v. *Vector Distribution Sys., Inc.,* 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognize in case law to have the dual ordinary meaning of connoting a term of approximation or a term of magnitude. See *Dana Corp.* v. *American Axle & Manufacturing, Inc.*, Civ. App. 04-1116, 2004 U.S. App. LEXIS 18265, *13-14 (Fed. Cir. Aug. 27, 2004) (unpublished). The term "substantially" is commonly used by claim drafters to indicate approximation. See *Cordis Corp.* v. *Medtronic AVE Inc.,* 339 F.3d 1352, 1360 (Fed. Cir. 2003) ("The patents do not set out any numerical standard by which to determine whether the thickness of the wall surface is 'substantially uniform.' The term 'substantially, ' as used in this context, denotes approximation. Thus, the walls must be of largely or approximately uniform thickness."); see also *Deering Precision Instruments, LLC* v. *Vector Distribution Sys., Inc.,* 347 F.3d 1314, 1322 (Fed. Cir. 2003); *Epcon Gas Sys., Inc.* v. *Bauer Compressors, Inc.,* 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, *Liquid Dynamics Corp.* v. *Vaughan Co.,* 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In *Cordis Corp.* v. *Medtronic AVE, Inc.,* 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In *Anchor Wall Systems* v. *Rockwood Retaining Walls, Inc.,* 340 F.3d 1298, 1311 (Fed. Cir. 2003)" Id. at 1311. Similarly, the plain language of Claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see *Deering Precision Instruments, L.L.C.* v. *Vector Distrib. Sys., Inc.,* 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., *Epcon Gas Sys., Inc.* v. *Bauer Compressors, Inc.,* 279 F.3d 1022 (Fed. Cir. 2002) (construing the terms "substantially constant" and "substantially below"); *Zodiac Pool Care, Inc.* v. *Hoffinger Indus., Inc.,* 206 F.3d 1408 (Fed. Cir. 2000) (construing the term "substantially inward"); *York Prods., Inc.* v. *Cent. Tractor Farm & Family Ctr.,* 99 F.3d 1568 (Fed. Cir. 1996) (construing the term "substantially the entire height thereof"); *Tex. Instruments Inc.* v. *Cypress Semiconductor Corp.,* 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see *AK Steel Corp.* v. *Sollac,* 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by *Pall Corp.* v. *Micron Separations, Inc.,* 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see *Verve LLC* v. *Crane Cams Inc.,* 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In *Andrew Corp.* v. *Gabriel Elecs. Inc.,* 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in *Ecolab Inc.* v. *Envirochem, Inc.,* 264 F.3d 1358, 1367, 60 USPQ2d 1173, 1179 (Fed. Cir. 2001) that "like the term 'about, ' the term 'substantially' is a descriptive term commonly used in patent claims to 'avoid a strict numerical boundary to the specified parameter, see *Ecolab Inc.* v. *Envirochem Inc.,* 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see *Pall Corp.* v. *Micron Seps.,* 66 F.3d 1211, 1217, 36 USPQ2d 1225, 1229 (Fed. Cir. 1995); see, e.g., *Andrew Corp.* v. *Gabriel Elecs. Inc.,* 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see *Ex parte Mallory,* 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" includes the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . ." Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see *Norian Corp.* v *Stryker Corp.,* 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

The present invention will now be described in detail with reference to embodiments thereof as illustrated in the accompanying drawings.

The pallet box provided herein combines a storage box and a pallet into a single unit. It is a durable container made of corrugated fiberboard that can host light-to-medium contents, even if they are loose and not packaged. The top and bottom planes of the pallet box both fully seal. A pressure-sensitive adhesive secures closure of the box. The bottom plane also features pegs, made of compressed fiberboard and attached by durable adhesive. These pegs allow the structure to serve as both a container and a pallet, with that pallet portion being a permanent part of the box. The pallet box can be moved by sliding the forks of a forklift in the open space between the pegs. There is little risk of loose contents falling out during the procedure because they are fully enclosed. If loose contents shift about inside the box, there is little risk of the pallet box falling off a pallet because that pallet is part of its structure. In addition to the protection of its contents, the pallet box may also protect people in its area of use. Workplace injuries involving pallets, even when moving them from place to place or while in storage, are quite common. The pallet box may reduce those risks.

The pallet box may be made of corrugated fiberboard of double-wall format and may measure 40"×48"×36" when assembled. Adhesive strips located on bottom and top flaps are included for sealing. Pegs are included on exterior bottom flaps of container and may be made of compressed corrugated fiberboard. Six pegs are included measuring 4"×6"×3" featured on exterior width-planes of closing flaps. Six other pegs are also included measuring 2"×6"×3" featured on interior width-planes of closing flaps.

The pallet box includes its pegs on the bottom surface and accommodates storage of many different items. It may eliminate the need for and cost of separate containers and pallets. The pallet box may allow movement and transport by forklift and pallet jack and may eliminate risks of a container shifting or falling from pallet during movement. It may eliminate the risk of damage to contents caused by shifting/falling from the pallet. The pallet box may completely enclose contents, unlike other light-to-medium content containers. Top and bottom flaps fully cover their planes when folded, unlike other light-to-medium content containers.

The pallet box may prevent loose contents from falling out, unlike previous implementations, and may protect stored contents from contacting elements outside of its structure, reducing risk of damage to contents. As noted, the pallet box may protect workers from common workplace injuries caused by ordinary pallets. It may reduce labor time and labor costs and may reduce storage space required for pallets not in use.

The box and pallet are one unit. Instead of needing two items, the box features pegs mounted on its bottom plane. No additional costs, no additional space that occasionally gets wasted, and no lost labor time or cost from getting and moving empty pallets are incurred.

The pallet box provided herein may have a total of four bottom flaps. The outer flaps, those with the pegs projecting from the exterior surface, will have wax paper protected adhesive strips on their interior surface. There may be a total of four top flaps. The interior surface of two opposing flaps will feature wax paper protected adhesive strips. The closing flaps may be large enough to completely close the bottom and top of the box so that contents do not fall out.

The adhesive strips on the bottom and top flaps may be used to securely close the top and bottom of the box without need for tape. The pegs may be made from the same material as the rest of the box. The pegs may be of greater density to sustain the weight of contained items.

The pallet box features a fiberboard construction with fully-closing flaps on both the top and bottom portions. Adhesive strips, covered by wax paper that may be removed when assembly of the structure to box format is desired, are featured on these flaps. Featured on the surface of the pallet box intended to be the bottom surface of the structure are the pegs—supporting legs made of the same fiberboard material—applied to strategic locations by adhesive.

The pallet box combines the ordinary separate units of storage container and pallet into a single unit. The pallet box stores various light-to-medium items in its sizable container. The pegs of the pallet box raise its container portion to a height that would accommodate insertion of the forks of a forklift or pallet jack in between said pegs.

The pallet box may eliminate the need for a container and a pallet to be separate items, and by the inclusion of those pallet-like peg implementations on its bottom surface. The pallet box may completely enclose its contents, unlike other structures for the containment of light-to-medium contents such as mail parcels.

The top and bottom flaps of the pallet box may completely cover their planes when folded, unlike other structures for the containment of light-to-medium contents. The pallet box may be an improvement to such containers that do not have closing flaps on their top planes. The pallet box may be an improvement over such containers in which an open area is still present on the bottom plane even when the bottom flaps are folded, and which commonly occurs due to the size, shape, and intended design of those bottom flaps.

By completely covering those planes, the pallet box leaves no open apertures through which contents might escape. By completely covering those planes, the pallet box better protects its contents from outside elements. The pallet box also protects its contents from ordinary risks of falling from a separate pallet. By including the pallet portion directly as part of its structure, the pallet box and its contents are unlikely to fall from the pallet box.

The pallet box may reduce risks of hazards within its storage environment which can occur due to containers and contents falling from separate pallets. The pallet box may reduce the time lost in recollection of container contents that might fall or be unintentionally removed from an ordinary container relying on a separate pallet, with no top-closing flaps, or with incompletely-closing bottom flaps.

The pallet box may reduce risks of damages to container contents that can occur in such circumstances with ordinary containers and pallets. The pallet box can also improve storage space in facilities in which the pallet box is used. The pallet box can be produced in many non-standard pallet sizes that are smaller than ordinary formats.

The pallet box may allow loading and unloading of cargo transport vehicles to be achieved more easily than is ordinarily done with regular containers with separate pallets. The adhesive strips of the pallet box may allow the flaps to be easily and securely sealed. The adhesive strips of the pallet box may eliminate the need for tape to seal the flaps.

The fiberboard material of the pallet box may be of single-wall, double-wall, and triple-wall formats. The pallet box may be made in variations that use corrugated plastics, and/or other types of material. The storage container and peg portions may be made of the same or different materials. Various metals may also be used and the pallet box can also be made in wooden crate varieties.

The pallet box can be made in various sizes and shapes, which may or may not comply with the dimensions of Production Ranks One through Ten (1-10) of the U.S. Grocery Manufacturers' Association, provided the outermost pegs on the bottom surface of the structure maintain a minimum interior distance gap of twenty-seven inches (27").

The outermost pegs of the pallet box may or may not be flush with the exterior endpoints of the structure. The pegs of the pallet box can be of various sizes and shapes.

Various quantities of pegs may be included on the pallet box and their quantity may vary based on total container size and intended weight capacity. Said pegs may be in various locations of the structure that accommodate the standard dimensions of the forks of forklifts and pallet jacks. The pallet box may feature skid structures, or others of relevant variety, in place of pegs.

The pallet box may use various types of pressure sensitive adhesives to secure its flaps. The pressure sensitive adhesives may be positioned at various points about the pallet box.

The container portion of the pallet box is made of a corrugated fiberboard of double-wall format, measuring forty inches in width by forty-eight inches in length by thirty-six inches in height (40"×48"×36") when fully assembled by folding. The flaps of both the top and bottom planes meet in planar centers of those planes, completely enclosing their endpoints.

Two (2) strips of pressure sensitive adhesive are featured on the interior planes of each of the two (2) length-wise flaps featured on the top and bottom planes of the unit, thus totaling eight (8) strips. The bottom plane of the pallet box can be made in both four (4)-way entry and two (2)-way entry models.

Strips of wax paper are applied to these pressure sensitive adhesive segments and to prevent their adhesive use until intended. When the strips are removed, the flaps are the last to be folded to form a top or bottom plane and allow the exterior, adhesive-hosting flaps to adhere to the interior flaps after folding.

On the exterior planes of each of the two (2) length-wise flaps of the bottom plane are the pegs, and which are attached to those exterior planes by pressure sensitive adhesive of a permanent variety. These pegs are made of compressed corrugated fiberboard of double-wall variety, and are featured for positioning at the width-wise borders of the assembled container, as well as its width-wise center.

Three (3) pegs are for placement at each of the width-wise borders, thus totaling six. These particular pegs each measure approximately four inches in width by six inches in length by three inches in height (4"×6"×3").

An additional three (3) pegs are for placement on the interior ends of those particular flaps, thus totaling six (6"). These other pegs each measure two inches in width by six inches in length by three inches in height (2"×6"×3"), and each has the same wider dimensions of the other pegs when the flaps are folded to form a sealed bottom plane.

A user may unfold the structure to box shape. The wax paper linings of the adhesive on the flaps of the bottom plane may be removed to seal that end of the structure.

The pallet box may then be used to accept and contain materials for storage. When its capacity is reached and/or the container is ready for transport, the wax paper linings of the adhesive on the flaps of the top plane may be removed to seal that top portion of the structure.

A user may then move a forklift or pallet jack so that its forks can be inserted between the pegs of the structure. The pallet box may then be lifted and moved to another location.

FIG. 1 is a diagram of the pallet box in accordance with an embodiment of the present disclosure. A system 100 of the pallet box is depicted in a flattened state 102 with a row of full-size pegs 104 and a row of half-size pegs 106 shown wherein a second row each of full-size pegs 104 and half-size pegs 106 are also present but not visible as they are affixed on underside portions of the pallet and are hence not visible. Folding the pallet box in a flattened state may cause the pallet box to be easier to use, store and transport.

Figure 2:
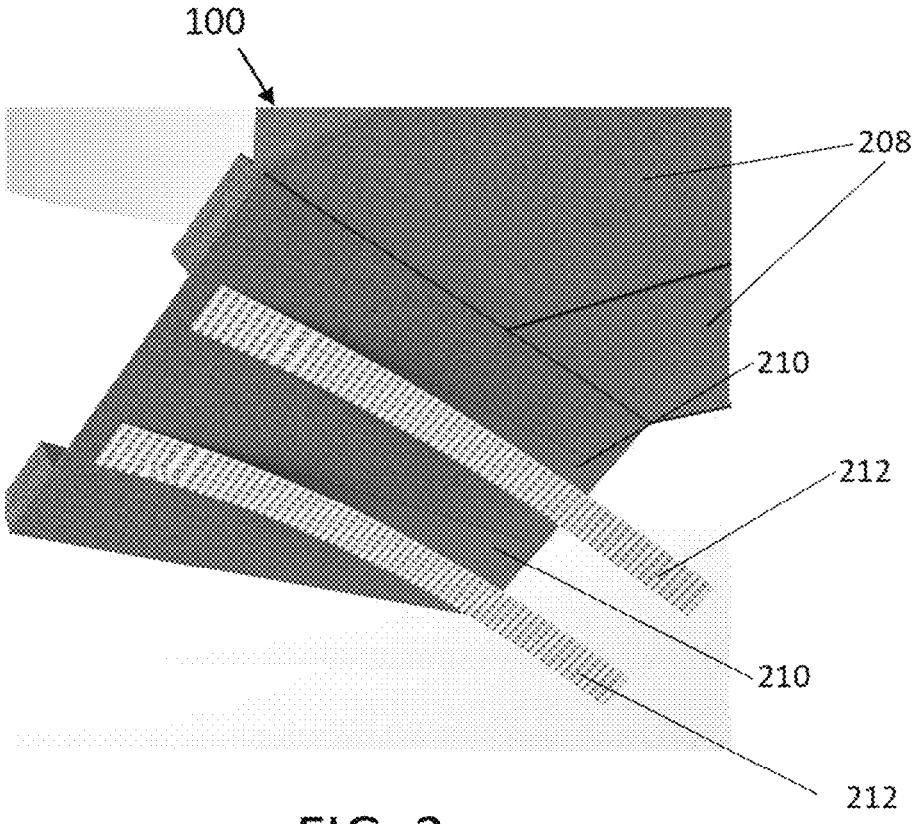
FIG. 2 is a diagram of the pallet box in accordance with an embodiment of the present disclosure, the pallet box exhibiting pressure-sensitive adhesive strips for adhering box flaps to corresponding flaps of the pallet box, the adhesive strips covered by wax paper strips prior to use.

FIG. 2 is a diagram of the pallet box in accordance with an embodiment of the present disclosure, the pallet box exhibiting pressure-sensitive adhesive strips 210 for adhering box flaps 208 to the body of the pallet box, the adhesive strips 210 covered by wax paper strips 212 prior to use.

Figure 3:
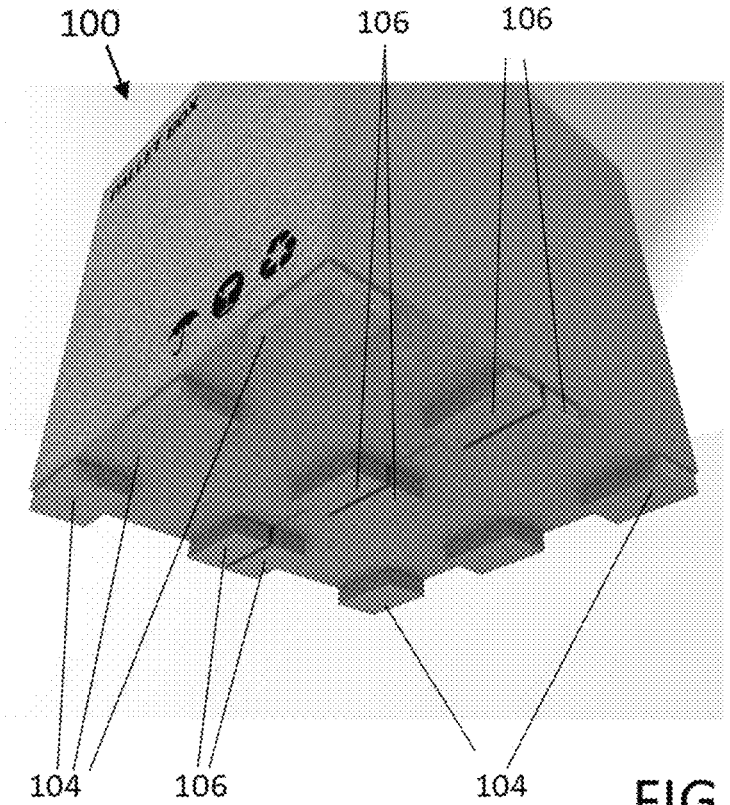
FIG. 3 is a diagram of the pallet box in accordance with an embodiment of the present disclosure, with the fully-assembled pallet box depicted in a side and bottom view, the view also depicting full and half-size pegs at a bottom panel of the pallet box for supporting the box.

FIG. 3 is a diagram of the pallet box in accordance with an embodiment of the present disclosure with the fully-assembled pallet box depicted in a side and bottom view, the view also depicting full-size pegs 104 and half-size pegs 106 at a bottom panel of the pallet box for supporting the box. When the pallet box is folded into a box shape, the half-size pegs 106 meet to form full-size pegs 104. In some instances of the present embodiment, the pallet box may include pegs comprising six full-sized pegs and six half-sized pegs, where the Six full-sized pegs may measure around 4"×6"×3" and may be featured on exterior width-planes. Moreover, six other half-sized pegs may also be included which may measure around 2"×6"×3" and be featured on interior width-planes of closing flaps. The half sized pegs may be positioned on flaps to meet when the box is sealed to create three full size pegs.

Figure 4:
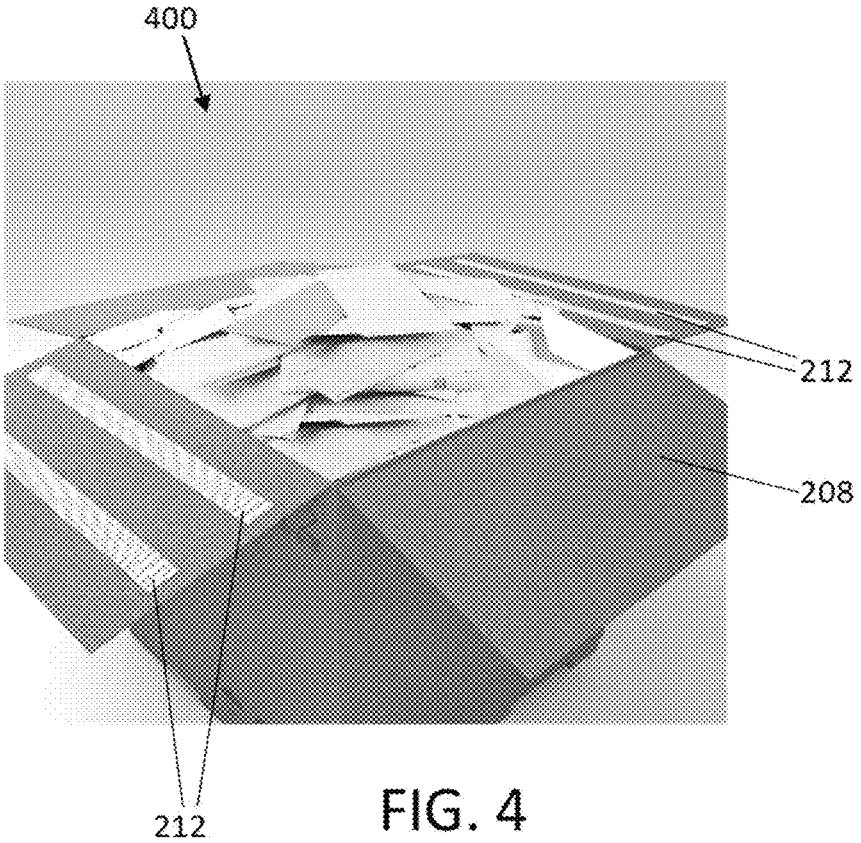
FIG. 4 is a diagram of the pallet box in accordance with an embodiment of the present disclosure, the pallet box depicted in an upright position with flaps open and the pallet box filled with mail and other objects.

FIG. 4 is a diagram of the pallet box in accordance with an embodiment of the present disclosure, the pallet box depicted in an upright position with flaps 208 open and the pallet box filled with mail and other objects. Also depicted are wax paper strips 212 that cover adhesive strips 210 (not visible in FIG. 4).

Figure 5:
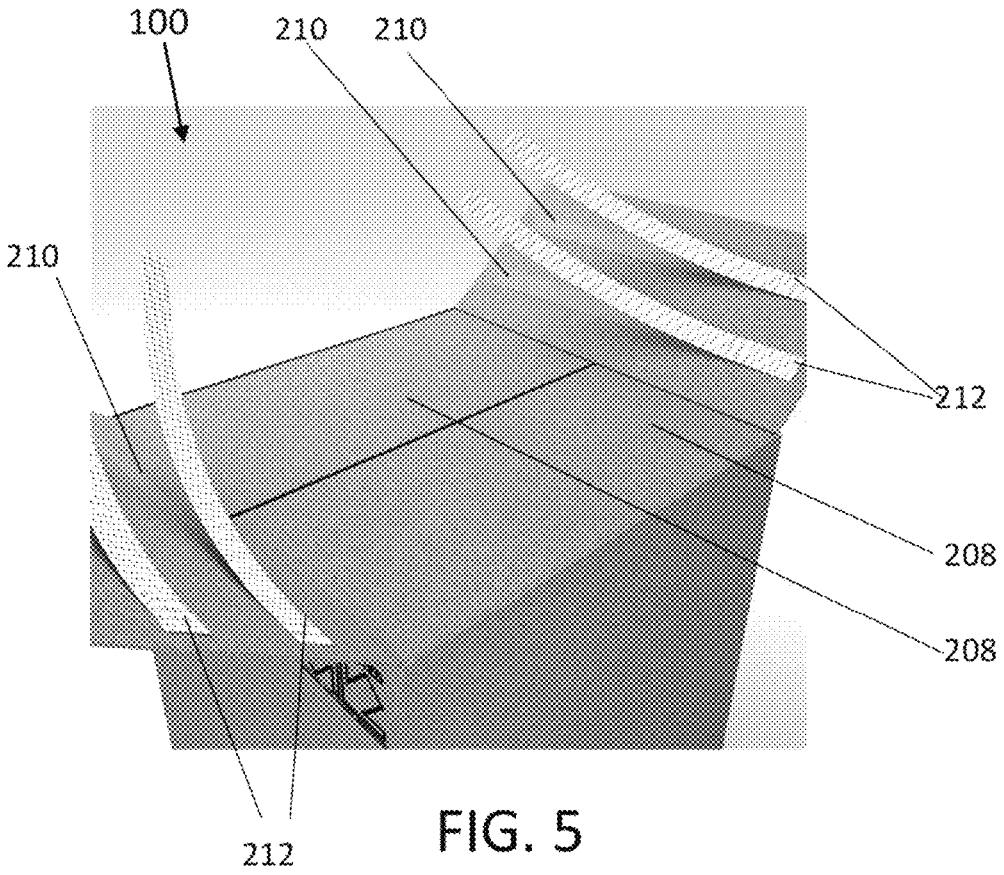
FIG. 5 is a diagram of the pallet box in accordance with an embodiment of the present disclosure, with adhesive strips on flaps shown and wax paper strips also shown, the wax paper strips covering the adhesive strips until the adhesive strips are needed for use.

FIG. 5 is a diagram of the pallet box in accordance with an embodiment of the present disclosure with adhesive strips 210 on flaps 208 shown and wax paper strips 212 also shown, the wax paper strips 212 covering the adhesive strips 210 until the adhesive strips 210 are needed.

Figure 6:
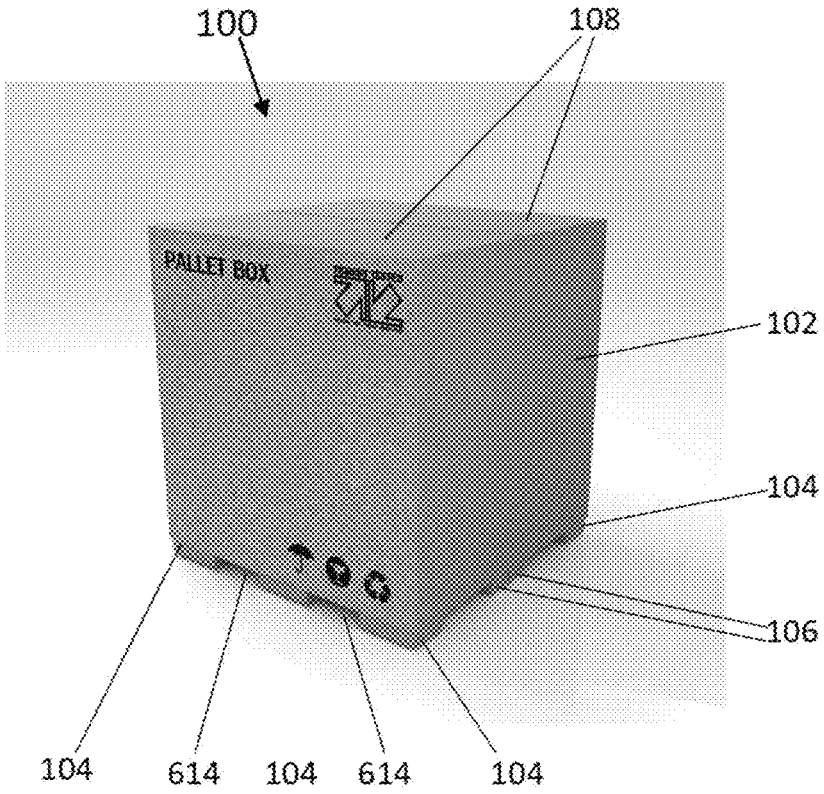
FIG. 6 is a diagram of the pallet box in accordance with an embodiment of the present disclosure, with the pallet box in a sealed and closed state and open slots at the box bottom for the acceptance of the forks from a fork lift or pallet dolly.

FIG. 6 is a diagram of the pallet box in accordance with an embodiment of the present disclosure with the pallet box in a sealed and closed states and open slots 614 at the box bottom for the acceptance of the forks from a fork lift or pallet dolly. Also depicted in FIG. 6 are full-size pegs 104, half-size pegs 106, and flaps 108.

Figure 7:
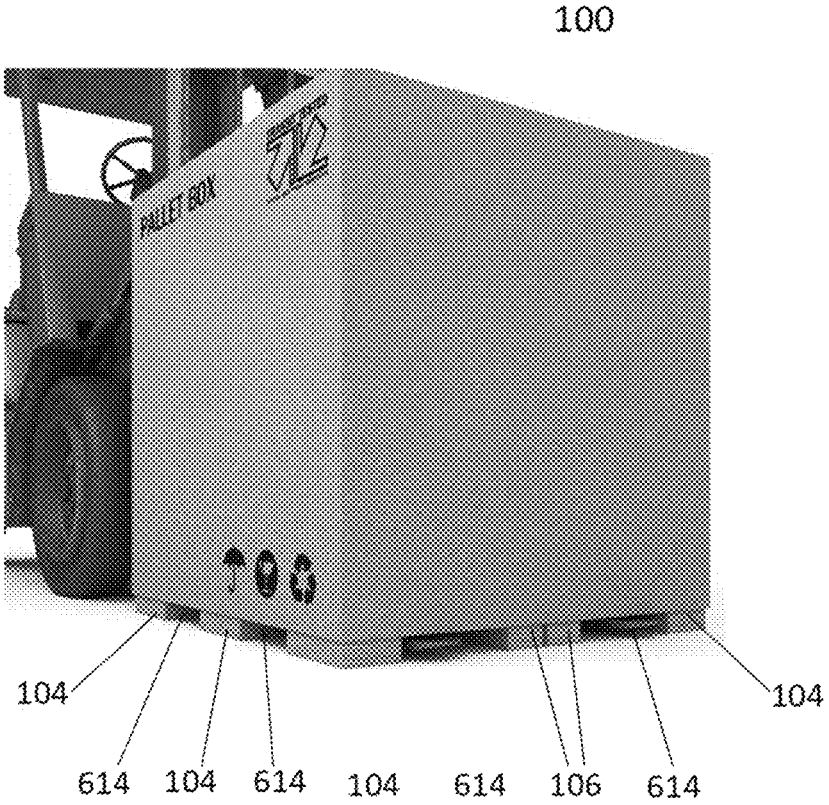
FIG. 7 is a diagram of the pallet box in accordance with an embodiment of the present disclosure, with the pallet box in closed condition and a forklift engaged with forks positioned in slots at the bottom of the pallet box.

FIG. 7 is a diagram of the pallet box in accordance with an embodiment of the present disclosure with the pallet box in closed condition and a forklift engaged with forks positioned in slots 614 at the bottom of the pallet box. The forks of a depicted forklift are shown protruding through open slots 614 of the pallet box. Also depicted in FIG. 7 are full-size pegs 104 and half-size pegs 106.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" claim limitation implies that the broadest initial search on 112 (6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112 (6) when such corresponding structures are not explicitly disclosed in the foregoing patent specification. Therefore, for any invention element(s)/structure(s) corresponding to functional claim limitation(s), in the below claims interpreted under 35 USC § 112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing a design for a pallet box more effectively according to the present invention will be apparent to those skilled in the art. Various aspects of the invention have been described above by way of illustration, and the specific embodiments disclosed are not intended to limit the invention to the particular forms disclosed. The particular implementation of the design for the pallet box may vary depending upon the particular context or application. By way of example, and not limitation, systems and methods of the pallet box and its use may lend itself, however, to similar techniques that may instead be applied to any type of container use and storage. Such implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

What is claimed is:

1. A system comprising a box with four bottom flaps, at least four durable pegs projecting from exterior surfaces of two opposing bottom flaps, the pegs positioned to function as a built-in pallet structure for the box, protected adhesive strips on interior surfaces of the two opposing bottom flaps configured to promote closure of the bottom flaps, four top flaps, interior surfaces of two opposing top flaps containing protected adhesive strips configured to promote closure of the top flaps, and a wax paper covering the adhesive strips prior to use of the strips, wherein the at least four durable pegs comprise six full-sized pegs and six half-sized pegs and wherein the half sized pegs are positioned on flaps to meet when the box is sealed to create three full-sized pegs.

2. The system of claim 1, wherein the pegs are not constructed from the same material as the box.

3. The system of claim 2, wherein peg material is denser than material composing the box.

4. The system of claim 3, wherein the denser peg material enables the pegs to sustain a weight of the box and a weight of items contained by the box.

5. The system of claim 4, wherein the positioning of the pegs forms slots on a bottom panel of the box.

6. The system of claim 1, wherein the slots are of dimensions such that forks of a material handling device fit into and extend through the slots.

7. The system of claim 6, wherein the slots accommodating full insertion of forks of the material handling device promotes the material handling device lifting the box.

8. The system of claim 7, wherein the top flaps and the bottom flaps are of dimensions enabling the top and bottom of the box to completely close.

9. The system of claim 8, wherein the adhesive strips on the bottom and top flaps securely close the top and bottom of the box.

10. The system of claim 9, wherein use of the adhesive strips one of reduces and alleviates a need to use adhesive tape.

11. The system of claim 10, wherein the pegs comprise skid structures.

12. The system of claim 1, wherein the box is constructed of fiberboard in a double-wall format.

13. The system of claim 12, wherein the pegs are made of compressed corrugated fiberboard of double-wall format.

14. The system of claim 13, wherein the pegs are featured for positioning at width-wise borders of the assembled container, as well as its width-wise center.

15. The system of claim 14, wherein the pegs are further featured for positioning at a width-wise center of the assembled container.

16. The system of claim 15, the system is folded to a flattened state when not in use.

17. A system comprising:

means for storing or collecting a material including at least an object;

means for closing a bottom portion of the material storing or collecting means and means for holding the material storing or collecting means in an open position;

means for allowing movement or transport of the material storing or collecting means by forklift or pallet jack;

wherein the movement or transport allowing means are position to function as a built-in pallet structure for the collecting or storing means;

means for closing a top portion of the storing or collecting material means;

means for promoting or securing closure of the means for holding the material storing or collecting means in an open position;

means for covering the means for promoting or securing closure until the closure promoting or securing means are needed for use;

and wherein the built-in pallet structure comprises of six full-sized pegs and six half-sized pegs and wherein the half-sized pegs are configured to be positioned on the closing means to meet when the closing means is sealed to generally create about three full-sized pegs.

18. A system comprising a box with four bottom flaps;

at least four durable pegs projecting from exterior surfaces of two opposing bottom flaps, the pegs positioned to function as a built-in pallet structure for the box;

adhesive strips on interior surfaces of the two opposing bottom flaps to promote closure of the bottom flaps;

four top flaps, interior surfaces of two opposing top flaps containing protected adhesive strips configured to promote closure of the top flaps;

and wax paper covering the adhesive strips prior to use of the strips, wherein the positioning of the pegs forms slots on a bottom panel of the box, wherein the slots are of dimensions wherein forks of a material handling device fit into and extend through the slots, wherein the slots accommodating full insertion of forks of the material handling device promotes the material handling device lifting the box, wherein the top flaps and the bottom flaps are of dimensions configured to enable the top and bottom of the box to completely close, wherein the adhesive strips on the bottom and top flaps configured to close the top and bottom of the box, wherein use of the adhesive strips one of reduces and alleviates a need to use adhesive tape, wherein the box is constructed of fiberboard in a double-wall format, wherein the pegs are made of compressed corrugated fiberboard of double-wall format, wherein the pegs are featured for positioning at width-wise borders of the assembled container, as well as its width-wise center, wherein the pegs are further featured for positioning at a width-wise center of the assembled container, wherein the pegs comprise six full-sized pegs and about six half-sized pegs and wherein the half sized pegs are positioned on flaps to meet when the box is sealed to create three full-sized pegs, and wherein the system is folded to a flattened state when not in use.

* * * * *